United States Patent [19]

Fall

[11] 4,200,342

[45] Apr. 29, 1980

[54] COMBINATION SOLID BEARING AND BALL BEARING SLIDE

[75] Inventor: Martin K. Fall, Indianapolis, Ind.

[73] Assignee: Herbert S. Fall, Indianapolis, Ind.

[21] Appl. No.: 854,825

[22] Filed: Nov. 25, 1977

[51] Int. Cl.[2] ..... F16C 21/00; F16C 29/00; F16C 35/02

[52] U.S. Cl. ..... 308/3.8; 308/6 R; 312/348; 312/341 R; 312/350

[58] Field of Search ..... 308/3.8, 3.6, 6 R, 6 C; 312/348, 341 R, 343, 333, 344, 345, 346, 349, 350

[56] References Cited

U.S. PATENT DOCUMENTS

| | | | |
|---|---|---|---|
| 3,133,768 | 5/1964 | Klakovich | 308/3.6 |
| 3,488,097 | 1/1970 | Fall | 308/3.8 |
| 3,937,531 | 2/1976 | Hagen et al. | 308/3.8 |

FOREIGN PATENT DOCUMENTS

| | | | |
|---|---|---|---|
| 5466 | 3/1933 | Australia | 308/3.8 |
| 72285 | 2/1976 | Australia | 312/341 R |

*Primary Examiner*—Douglas C. Butler

*Attorney, Agent, or Firm*—Jenkins, Coffey, Hyland, Badger & Conard

[57] ABSTRACT

A drawer slide mechanism for detachably mounting a drawer in a cabinet includes a first slide member for rigidly mounting on the cabinet, a second slide member slidably engaging the first slide member, and a third slide member for rigidly mounting on the drawer. The first slide member provides a pair of facing tracks. The second slide member provides a second pair of tracks in solid bearing engagement with the first tracks. The second slide member further includes a third pair of tracks which face in opposite directions between the tracks of the second pair. The tracks of the third pair form, with a fourth pair of tracks provided on the third slide member, a pair of bearing races for receiving ball- or roller bearings. The fourth tracks face toward one another.

5 Claims, 3 Drawing Figures

COMBINATION SOLID BEARING AND BALL BEARING SLIDE

This invention relates to drawer slide hardware and particularly to a drawer slide mechanism which provides a combination solid bearing and ball- or roller bearing slide mechanism, the initial extension of the drawer from a cabinet in which it is mounted being provided by the ball- or roller bearing mechanism to provide initial ease of movement of the drawer with respect to the cabinet. Subsequently, the solid bearing mechanism begins to extend, the solid bearing mechanism providing more friction to brake the movement of the drawer relative to the cabinet in which it is mounted prior to full extension of the drawer from the cabinet.

There are several well-known types of multiple-member slide mechanisms which includes combination solid bearing and ball- or roller bearing movements. See, for example, Hagen et al, U.S. Pat. No. 3,937,531.

It is an object of the present invention to provide a simple combination solid bearing and ball- or roller bearing type of multiple member drawer slide mechanism.

According to the invention, a drawer slide mechanism includes a first means providing a pair of first tracks, second means providing a pair of second tracks engaging the first tracks and a third pair of tracks, and third means providing a fourth pair of tracks. The first, second and third means extend longitudinally of one another, the first and second means being longitudinally slidably connected by engagement of the first and second pairs of tracks and the second and third means being longitudinally slidably connected by a plurality of bearings in races provided by cooperation between each track of the third pair and a respective track of the fourth pair. The first tracks are disposed on the first means in facing relation. The second tracks are disposed on the second means for engagement in respective first tracks. The third tracks are mounted on the second means in nested orientation between the second tracks, and in oppositely facing relation to one another. The fourth tracks are disposed on the third means in facing relation to lie between respective second and third tracks, the tracks of the third and fourth pairs forming with one another the bearing races. Each pair of tracks includes a vertically upper track and a vertically lower track.

In the illustrative embodiment, the first means comprises a first track member for stationarily mounting on the cabinet, the second means comprises a second track member and the third means comprises a third track member for stationarily mounting to a drawer which is extensible outwardly from, and retractable inwardly into, the cabinet.

Further according to the illustrative embodiment, the first track member includes means for bearing weight of the extended second and third track members and drawer. The roller means includes an axle mounted adjacent the lower first track, a plurality of bearing surrounding the axle and a wheel retaining the bearings adjacent the axle and providing a smooth, continuous peripherally radially outwardly facing surface for contacting a downwardly facing surface of the lower second track to prevent the second track member from binding against the first track members as the second track member is projected outwardly to its full extent with respect to the first track member.

Further according to an illustrative embodiment, the first track member includes means providing a disconnect lever adjacent the distal end of the first track member. The disconnect lever includes an engaging portion and the second track member includes means providing a notch for engagement by the engaging portion. The lever illustratively is spring-biased to urge the engaging portion into the notch. The lever is disposed adjacent the upper tracks of the first and second pairs of tracks.

The invention may best be understood by reference to the following description and accompanying drawings which illustrate the invention. In the drawings.

Figure 1:
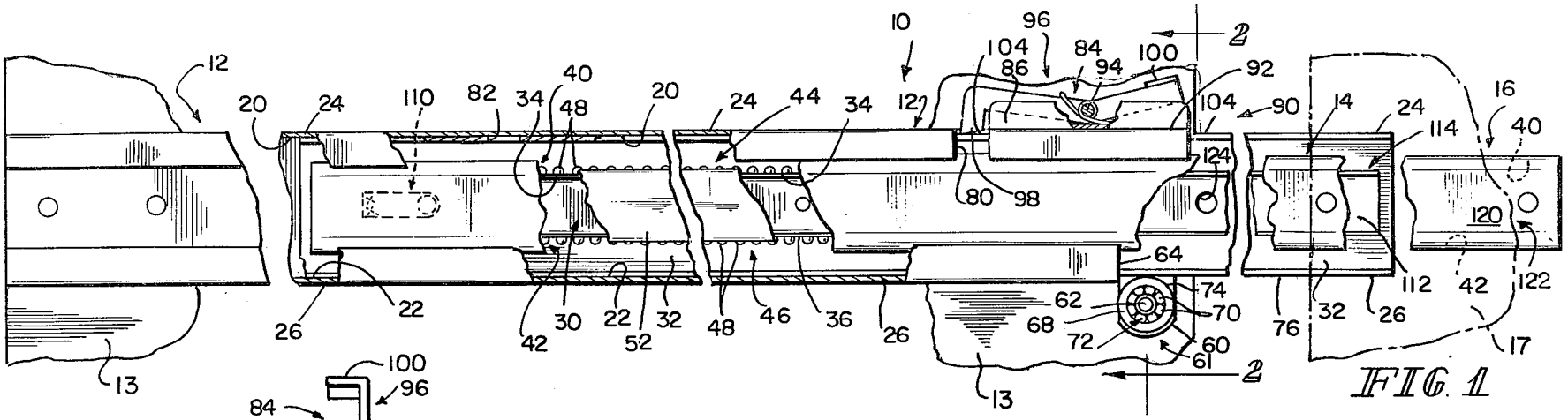
FIG. 1 is a partly fragmentary side elevational view, partly broken away, of a drawer slide mechanism according to the present invention.
Figure 3:
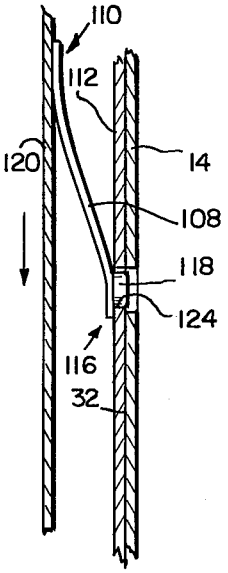
FIG. 3 is a fragmentary sectional view taken generally along section lines 3—3 of FIG. 2.

A drawer slide mechanism assembly 10 includes a first slide member 12 for stationary attachment to a chest, cabinet or other storage device 13, shown fragmentarily, a second or intermediate slide member 14, and a third or outer slide member 16 for stationary attachment to a drawer or equipment 17, shown fragmentarily and in phantom lines for purposes of clarity, to mount it movably with respect to the cabinet.

First slide member 12 includes longitudinal edges defining a first pair of spaced apart vertically upper and lower facing channels or tracks 20, 22 which slidably engage corresponding upper and lower second tracks 24, 26, respectively, formed on the opposite longitudinal edges of slide member 14.

Slide member 14 is also provided with a somewhat C-shaped channel section 30 which is attached to the flat vertical inner surface 32 of slide member 14 by spot welds or other suitable means. Channel section 30 provides a third pair of vertically upper and lower tracks 34, 36, respectively. Tracks 34, 36 face away from one another toward their respective adjacent second tracks 24, 26, respectively. Tracks 34, 36 thereby assume a somewhat "nested" orientation between second tracks 24, 26 of slide member 14.

Figure 2:
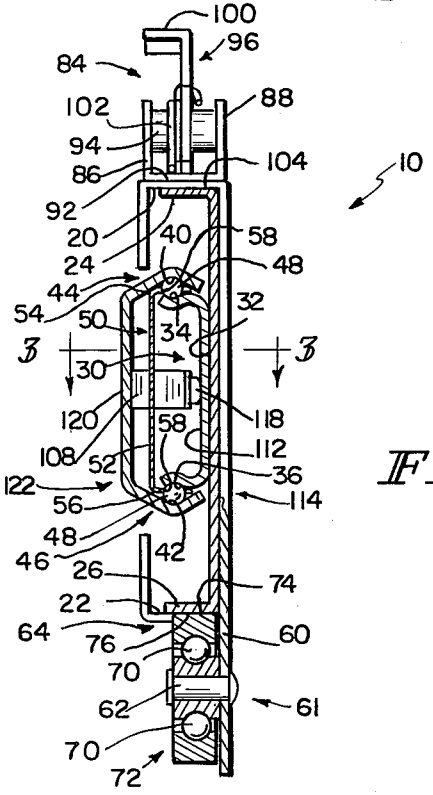
FIG. 2 is a sectional view taken generally along section lines 2—2 of FIG. 1.

The third, or outer, slide member 16 provides a pair of spaced apart, facing vertically upper and lower fourth tracks 40, 42 respectively. Tracks 40, 42 lie vertically above and below their respective upper and lower third tracks 34, 36 to provide between tracks 40, 34 an upper bearing race 44 and between tracks 36, 42 a lower bearing race 46. Bearing races 44, 46 are provided with ball bearings 48 which movably support third slide member 16 longitudinally with respect to second slide member 14. Bearings 48 in the upper and lower races 44, 46 are held in spaced apart relation to their adjacent bearings by a thin metal bearing plate or "cage" 50 which is somewhat channel-shaped to provide a central vertically extending plate portion 52 from the vertically upper and lower edges of which project a generally horizontal portion 54 and a generally horizontal portion 56, respectively. Each of portions 54, 56 is provided with a plurality of circular apertures 58 (FIG. 2.). Upper and lower portions 54, 56 project into the upper and lower bearings races 44, 46, respectively. Apertures 58 are sized loosely to receive bearings 48 to permit them to roll freely as the third slide member 16 is extended and retracted with respect to the second slide member 14.

To aid in preventing binding of the solid bearing surfaces provided between first slide member 12 and second slide member 14 by their respective upper tracks 20, 24 and lower tracks 22, 26, first slide member 12 is provided with a vertically downwardly projecting mounting tag or ear 60. A bearing assembly 61 including a cylindrical axle 62 projects outwardly from ear 60 beneath lower first track 22 and beyond the outer or distal end 64 of track 22 of slide member 12. A wheel 68 is mounted on axle 62, the wheel being supported rotatably on axle 62 by a plurality of ball bearings 70 housed in the race 72 provided between wheel 68 and axle 62. The radially outwardly facing peripheral surface 74 of wheel 68 is smooth and lies adjacent the outwardly and downwardly facing surface 76 of lower second track 26. In the final stages of extension of slide member 14 longitudinally outwardly with respect to slide member 12, surface 76 helps support the load presented on the solid bearing surfaces of tracks 20, 22, 24, 26 by slide members 14, 16 and the drawer (not shown) and minimizes the possibility of binding of slide member 14 against slide member 12.

As best illustrated in FIG. 1, the upper first and second tracks 20, 24, respectively, are provided with vertically facing openings or notches 80, 82, respectively, which, for one position of slide members 12, 14 are in vertical alignment. This position of slide members 12, 14 in which notches 80, 82 are in vertical alignment occurs at the full extension of slide member 14 with respect to slide member 12. A generally U-shaped support 84 with opposed vertical walls 86, 88 extends longitudinally of upper track 20 of slide member 12 and is mounted adjacent the distal end 90 thereof. Support 84 is spot-welded or otherwise attached to the vertically upwardly facing outside surface 92 of track 20 to open upwardly. An axle 94 is supported between walls 86, 88. Axle 94 pivotally supports a lever 96 for movement about axle 94. Lever 96 includes an engagement end 98 and an actuation end 100, and is urged by a spring 102 such that engagement end 98 is urged downwardly through notch 80 against the outer, vertically upwardly facing surface 104 of upper second track 24. When slide member 14 has reached its full projection with respect to slide member 12, engagement end 98 moves under the urging of spring 102 through opening 82 in upper second track 24 to prevent further movement of slide member 14 in either direction. Lever 96 can be pivoted about axle 94 against spring 102 to disengage end 98 thereof from notch 82 for movement of the drawer back into the cabinet, and also for disengagement of slide member 14 from slide member 12 and disengagement of the drawer from the cabinet.

To prevent excessive movement of slide member 16 with respect to slide member 14 various structures can be provided. For example, one or more of tracks 34, 36, 40, 42 can be provided with a dimple (not shown) which projects into its respective bearing race 44, 46 to prevent movement of bearings 48 past the dimple.

Alternatively, a flexible metal strip 108 can be provided having a proximal end 110 for attachment to the central vertical portion 120 of the generally C-shaped channel 122 providing the upper and lower fourth tracks 40, 42. The inside surface 112 of channel section 30 is provided with an aperture 124 adjacent its distal end 114. The distal end 116 of metal strip 108 is provided with a locking buttom 118. When slide member 16 is projected substantially fully outwardly from slide member 14, strip 108 urges button 118 into engagement with aperture 124 stopping movement of slide member 16 with respect to slide member 14. To retract slide member 16 back into slide member 14, it is necessary to depress button 118 to disengage it from aperture 124 manually.

There is thus provided a combination solid bearing and ball- or roller bearing slide assembly in which movement of the drawer relative to the cabinet initially is relatively easy owing to the low coefficient of friction provided by the ball- or roller bearings in their races. The coefficient of friction increases progressively as the drawer reaches its fully extended position with respect to the cabinet, since, as extension of the assembly 10 continues, slide member 14 will begin to move on the solid bearing surfaces provided between tracks 20, 24 and 22, 26. The coefficient of friction between tracks 20, 24 and 22, 26 is greater than the coefficient of friction provided by the bearings 48. Further significant advantages are achieved with the structure of the instant arrangement, including the anti-binding feature provided by the bearing assembly 61 provided beyond the distal end 64 of lower track 22 of the first pair of tracks, the bearing assembly supporting the outside surface 76 of the lower track 26 of the second pair of tracks 24, 26.

Additionally, the assembly 10 incorporates a disconnect feature for the solid bearing portion of the drawer slide. The disconnect feature includes lever 96 which permits the drawer to be removed from the cabinet and replaced therein.

Further, the illustrated construction provides a slide assembly which is very narrow between the side of the drawer and the supporting cabinet structure.

What is claimed is:

1. A slide assembly comprising a first track member providing a pair of first tracks, a second track member providing a pair of second tracks engaging the first tracks and a third pair of tracks, each of the first, second and third pairs of tracks including an upper track and a lower track, and the third track member providing a fourth pair of tracks, the first, second and third track members each having a proximal end and a distal end, the first track member being stationarily mounted on a cabinet and the third track member being stationarily mounted on a drawer extensible outwardly from, and retractible inwardly into, the cabinet, the first, second and third track members extending longitudinally of one another, the second track member being movable outwardly and inwardly longitudinally from the distal end of the first track member and the third track member being movable outwardly and inwardly longitudinally of the distal end of the second track member, the first and second track members being longitudinally slidably connected by engagement of respective tracks of the first and second pairs, and the second and third track members being longitudinally slidably connected by interpositioning between each track of the third pair and a respective track of the fourth pair a plurality of bearings, the first tracks being disposed on the first track member in facing relation, the second tracks being disposed on the second track member for engagement in the respective first tracks, the third tracks being mounted on the second track member in nested orientation to the second tracks and in oppositely facing relation to one another, and the fourth tracks being disposed in facing relation to lie between respective second and third tracks, the first track member including roller means for bearing weight of the extended second and third track members and drawer.

2. The apparatus of claim 1 wherein the roller means includes an axle mounted to project outwardly from a lower portion of the distal end of the first track member, a plurality of bearings surrounding the axle and a wheel retaining the bearings adjacent the axle and providing a smooth, continuous peripheral surface contacting a downwardly facing surface of the lower one of the second tracks.

3. A slide assembly comprising a first track member providing a pair of first tracks, a second track member providing a pair of second tracks engaging the first tracks and a third pair of tracks, each of the first, second and third pairs of tracks including an upper track and a lower track, and the third track member providing a fourth pair of tracks, the first, second and third track members each having a proximal end and a distal end, the first track member being stationarily mounted on a cabinet and the third track member being stationarily mounted on a drawer extensible outwardly from, and retractible inwardly into, the cabinet, the first, second and third track members extending longitudinally of one another, the second track member being movable outwardly and inwardly longitudinally from the distal end of the first track member and the third track member being movable outwardly and inwardly longitudinally of the distal end of the second track member, the first and second track members being longitudinally slidably connected by engagement of respective tracks of the first and second pairs, and the second and third track members being longitudinally slidably connected by interpositioning between each track of the third pair and a respective track of the fourth pair a plurality of bearings, the first tracks being disposed on the first track member in facing relation, the second tracks being disposed on the second track member for engagement in the respective first tracks, the third tracks being mounted on the second track member in nested orientation to the second tracks and in oppositely facing relation to one another, and the fourth tracks being disposed in facing relation to lie between respective second and third tracks, the first track member including means providing a disconnect lever adjacent its distal end, the disconnect lever including an engaging portion and each of the first and second track members including means providing a notch for engagement by the engaging portion.

4. The apparatus of claim 3 wherein the lever is spring-biased to urge the engaging portion into the notches.

5. The apparatus of claim 4 wherein the disconnect lever is disposed adjacent the upper tracks of the first and second pairs and the notches are formed in such upper tracks.

* * * * *